US006536252B1

(12) United States Patent
Waring

(10) Patent No.: US 6,536,252 B1
(45) Date of Patent: Mar. 25, 2003

(54) NON-METALLIC HYDRAULIC EXPANSION MANDREL

(75) Inventor: Thomas Waring, Cambridge (CA)

(73) Assignee: Babcock & Wilcox Canada Ltd., Cambridge (CA)

( * ) Notice: Subject to any disclaimer, the term of this patent is extended or adjusted under 35 U.S.C. 154(b) by 0 days.

(21) Appl. No.: 10/078,751

(22) Filed: Feb. 19, 2002

(51) Int. Cl.[7] ..... B21D 22/00; B21D 26/02; B21D 39/08

(52) U.S. Cl. ..... 72/62; 72/58; 72/370.8; 29/421.1

(58) Field of Search ..... 72/61, 62, 54, 72/58, 370.8; 29/421.1

(56) References Cited

U.S. PATENT DOCUMENTS

| | | | | | |
|---|---|---|---|---|---|
| 605,195 | A | | 6/1898 | Birtwisle | |
| 633,430 | A | | 9/1899 | Crowden | |
| 2,460,580 | A | | 2/1949 | Huber | |
| 3,977,068 | A | | 8/1976 | Krips | |
| 3,979,810 | A | | 9/1976 | Krips et al. | |
| 4,000,896 | A | | 1/1977 | Lauraitis | |
| 4,055,063 | A | * | 10/1977 | Krips et al. | 72/62 |
| 4,125,937 | A | | 11/1978 | Brown et al. | |
| 4,159,564 | A | | 7/1979 | Cooper | |
| 4,359,889 | A | * | 11/1982 | Kelly | 72/62 |
| 4,418,556 | A | * | 12/1983 | Galle et al. | 72/62 |
| 4,445,261 | A | | 5/1984 | Kelly | |
| 4,467,630 | A | * | 8/1984 | Kelly | 72/62 |
| 4,502,308 | A | * | 3/1985 | Kelly | 72/58 |
| 4,557,128 | A | * | 12/1985 | Costabile | 72/62 |
| 4,616,392 | A | | 10/1986 | Snyder | |
| 4,751,836 | A | * | 6/1988 | Breese | 72/62 |
| 4,761,981 | A | * | 8/1988 | Kelly | 29/421.1 |
| 4,802,273 | A | | 2/1989 | Widart | |
| 4,951,492 | A | | 8/1990 | Vogt | |
| 5,392,626 | A | | 2/1995 | Blezard et al. | |
| 5,901,594 | A | * | 5/1999 | Wasson et al. | 72/58 |
| 6,305,204 | B1 | * | 10/2001 | Tauzer | 72/62 |

* cited by examiner

*Primary Examiner*—David Jones
(74) *Attorney, Agent, or Firm*—Kathryn W. Grant; Eric Marich

(57) ABSTRACT

A hydraulic expansion mandrel for expanding tubes in a heat exchanger tube bundle into a tubesheet is formed from a non-metallic material, such a carbon fiber-reinforced material. The mandrel includes an elongated cylinder having a tip, a fluid supply end and a reduced diameter section. A pair of O-rings separates the reduced diameter section from the tip and fluid supply end of the elongated cylinder. An adjustment shim, located between a threaded collar and a locking stop collar, adjusts the length of the mandrel inserted into a tube.

7 Claims, 1 Drawing Sheet

NON-METALLIC HYDRAULIC EXPANSION MANDREL

FIELD AND BACKGROUND OF INVENTION

The present invention relates generally to the field of assembling heat exchange tubes and in particular to a new and useful non-metallic mandrel for insertion into a tube to provide hydraulic pressure and expand the tube against a surrounding tubesheet.

In the power plant field, a tubesheet is used for a nuclear steam generator, heat exchanger or a similar component that houses several thousand tube ends. The tube sheet has numerous pre-drilled holes which allows for each tube end to be inserted therethrough. The tube ends are welded to the tubesheet and circumferentially expanded into the tubesheet holes through virtually the full thickness of the tubesheet. This process is commonly referred to as full depth expansion.

The expansion of the tube ends can be achieved through mechanical or hydraulic processes. When manufacturing components for a nuclear steam generator, it is preferable that hydraulic expansion be used. Hydraulic expansion is the recommended method for nuclear steam generators because it produces less residual stress in the tube, and reduces the potential for stress corrosion cracking compared to other expansion methods. Hydraulically expanding the tube into a hole in the tubesheet closes the crevice between the tube and the hole thereby eliminating a potential corrosion site.

After being welding to the tubesheet, each tube is expanded into the tubesheet by inserting a hydraulic expansion mandrel into the tube. Steel hydraulic expansion mandrels are well known in the art, such as those manufactured by Haskel International, Inc. Other mandrels are described in U.S. Pat. No. 3,977,068, which illustrates a mandrel having a frusto-conical tip. The expansion zone of the mandrel, located between a pair of seals, such as O-rings, has a smaller diameter than the tip and the opposite end of the mandrel. A high pressure fluid, such as distilled water at 35,000 psi (2413 bar), is injected through the mandrel into the space between the smaller diameter portion of the mandrel and the tube wall to expand and seal the tube against the surrounding tubesheet. The mandrel can then be extracted from the expanded tube.

U.S. Pat. No. 4,802,273 teaches another mandrel having a particular seal configuration for isolating the reduced-diameter portion of the mandrel within a tube.

Neither of these two patents suggests using materials other than steel for the mandrel. Mandrels for expanding tubes known to the inventor are presently only made of steel.

Steel mandrels have been found to have some drawbacks. When the mandrel is moved in and out of the tubes, it is fairly common for the operators to inadvertently scratch, gall and mar the inside of the tubes via metal to metal contact between the tubes and the mandrel. Steel mandrels are difficult for people to operate, since the weight of steel significantly fatigues the operator after a period of use, e.g. after moving the mandrel in and out of the thousands of tubes that can be found in a large heat exchanger. Further still, steel mandrels are prone to problems due to mandrel stretch.

Mandrels having plastic sleeves are also known, but these mandrels have problems as well. In particular, if the sleeve should fail, operators may cause damage to tubes by thinking the mandrels are protected. Also, the plastic can pick up and become embedded with grit, which scratches and mars tubes when the "protected" mandrel is inserted and removed.

Further, on commercially available mandrels, the seals used to isolate the reduced-diameter section where the pressurized fluid is injected typically have many small parts. These seals tend to fail due to fatigue after long use, which causes additional damage to the tubes.

SUMMARY OF INVENTION

It is an object of the present invention to provide a tube expansion mandrel that does not scratch the tube to be expanded.

It is another object of the present invention to provide a tube expansion mandrel which is lightweight for easier use by operators.

It is a still further object of the invention to provide a tube expansion mandrel having few moving parts in order to reduce the likelihood of failure.

It is yet another object of the invention to provide a mandrel with improved tensile properties thereby reducing or eliminating problems due to mandrel stretch.

Accordingly, a hydraulic tube expansion mandrel is provided constructed of a fiber-reinforced material such as carbon fiber-reinforced material. O-ring seals are provided around a reduced-diameter section for isolating the region where a pressurized fluid is provided when the mandrel is inserted in a tube being expanded. An adjustment shim, located between a threaded collar and a locking stop collar, adjusts the length of the mandrel inserted into a tube.

Accordingly, a mandrel for hydraulically expanding a tube is provided which comprises an elongated cylinder having a tip, a reduced diameter section and a fluid supply end. A pair of O-rings separates the reduced diameter section from the tip and fluid supply end of the elongated cylinder. The elongated cylinder is made of a fiber-reinforced material In an alternate embodiment, a mandrel for hydraulically expanding a tube is provided which comprises an elongated cylinder made of a carbon fiber-reinforced material produced via filament winding carbon fibers. The elongated cylinder has a tip, a reduced diameter section and a fluid supply end. A pair of O-rings separaties the reduced diameter section from the tip and fluid supply end of the elongated cylinder. A split threaded collar is secured to the fluid supply end and a locking stop collar having a front edge is fitted over the fluid supply end adjacent the reduced diameter section. An adjustment shim is located between the split threaded collar and the locking stop collar for adjusting the length to which the mandrel can be inserted into the tube.

In yet another embodiment, a method for hydraulically expanding a tube, comprises the following steps: a) providing an elongated cylinder made of a carbon fiber-reinforced material having a tip, a reduced diameter section and a fluid supply end, b) providing a pair of O-rings separating the reduced diameter section from the tip and fluid supply end of the elongated cylinder, c) inserting the elongated cylinder into a tube, and d) introducing a high pressure fluid via the fluid supply end into the reduced diameter section to hydraulically expand the tube.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

The SOLE figure is a partial sectional view of a mandrel according to the invention.

DESCRIPTION OF THE PREFERRED EMBODIMENTS

Figure 1:
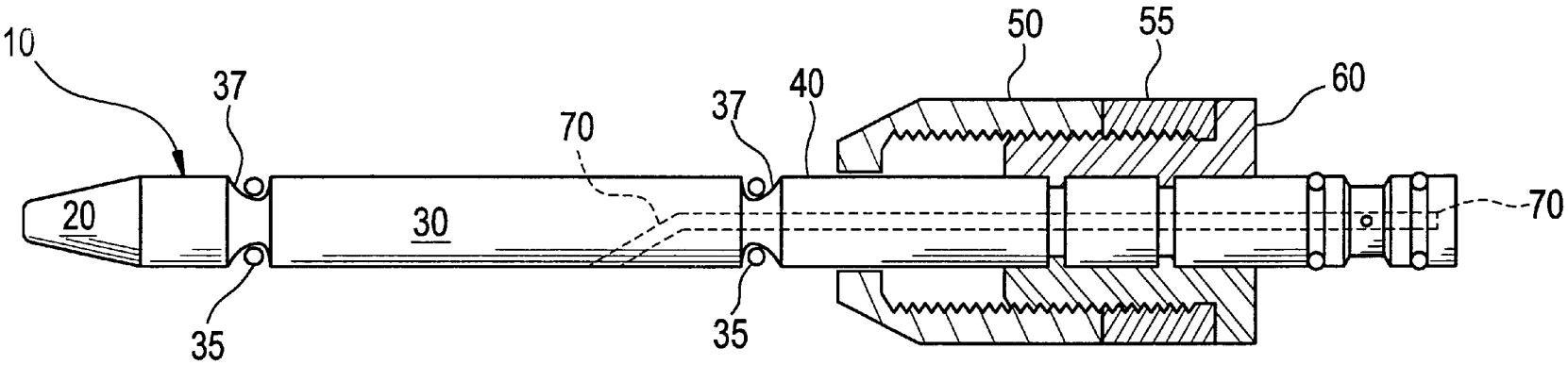

Referring now to the drawing, in which like reference numerals are used to refer to the same or similar elements, a hydraulic expansion mandrel 10 is provided having a tip 20, a reduced diameter section 30 and a fluid supply end 40. The mandrel 10 is generally cylindrical for fitting inside tubes of a heat exchanger assembly (not shown). The tip 20 is preferably conical or frusto-conical to assist operators in lining up and inserting the mandrel 10 into tubes.

The reduced diameter section 30 has a diameter which is only slightly less than the tip 20 and fluid supply end 40 of the mandrel 10. A fluid supply 70 is provided through the mandrel 10 to reduced diameter section 30.

A pair of self-releasing grooves 37 separate the reduced diameter section 30 from the tip 20 and the fluid supply end 40. An O-ring 35 is provided in each self-releasing groove 37 to seal the mandrel 10 against a tube inner diameter (ID) when the mandrel 10 is inserted inside a tube.

A split threaded collar 60 is secured to the fluid supply end 40 of the mandrel 10. A locking stop collar 50 fits over the fluid supply end 40 of the mandrel 10 adjacent the reduced diameter section 30. An adjustment shim 55 fits between the threaded collar 60 and locking stop collar 50 to adjust the length of the mandrel 10 which can be inserted into a tube.

Depending on the desired position of the reduced diameter section 30 of the mandrel 10 inside a tube, the locking stop collar 50 position can be adjusted by threading more or less of the collar 50 onto threaded collar 60. The front edge of locking stop collar 50 prevents the mandrel 10 from being inserted into a tube further and ensures that the mandrel will be inserted into each tube a consistent distance from the tube end.

The mandrel 10 is constructed of tubing made from a fiber-reinforced material, such as a carbon fiber-reinforced composite, using known techniques such as filament winding. For example a carbon fiber-reinforced composite can be made via the method described in U.S. Pat. No. 4,000,896, assigned to the Babcock & Wilcox Company, which is incorporated by reference as though fully set forth herein. Filament winding employs continuous composite filaments and epoxy resin, which are "wetted out" or pre-resined, and then wound together in tension for maximum strength and consistency. Filament winding offers close control of fiber orientation, wet-out and tension while minimizing voids. The filament wound tube can be cured to further improve strength.

The fiber materials employed in the present invention are preferably high modulus carbon fibers. Carbon fiber materials are lightweight, yet strong enough to withstand the fluid pressures provided through fluid supply 70. The tensile properties of carbon fiber materials greatly reduce or eliminate the problem of mandrel stretch common with steel mandrels. Further, the carbon fiber material will not scratch tubes when a mandrel made of carbon fiber material is repeatedly moved from tube to tube in a heat exchanger bundle.

The subject invention also eliminates the small, highly stressed threaded connections which are commonly used with steel mandrels. Eliminating these small threaded connections make the present invention safer for the operators to use, and reduces the potential for tube damage, in the event of mandrel failure.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. For example aramid fibers such as Kevlar®, a high modulus fiber available from Dupont, Inc., can be used in place of the carbon fibers.

I claim:

1. A mandrel for hydraulically expanding a tube, comprising:

an elongated cylinder having a tip, a reduced diameter section and a fluid supply end;

a pair of O-rings separating the reduced diameter section from the tip and fluid supply end of the elongated cylinder; and wherein the elongated cylinder is made of a fiber-reinforced material.

2. The mandrel of claim 1, wherein the elongated cylinder is produced via filament winding.

3. The mandrel of claim 1, wherein the fiber-reinforced material is a carbon fiber composite.

4. The mandrel of claim 1, wherein the fiber-reinforced material is an aramid fiber composite.

5. The mandrel of claim 1, further comprising:

a split threaded collar secured to the fluid supply end;

a locking stop collar fitted over the fluid supply end adjacent the reduced diameter section, the locking collar having a front edge; and an adjustment shim located between the split threaded collar and the locking stop collar for adjusting the length to which the mandrel can be inserted into the tube.

6. A mandrel for hydraulically expanding a tube, comprising:

an elongated cylinder made of a carbon fiber-reinforced material produced via filament winding carbon fibers, the elongated cylinder having a tip, a reduced diameter section and a fluid supply end;

a pair of O-rings separating the reduced diameter section from the tip and fluid supply end of the elongated cylinder;

a split threaded collar secured to the fluid supply end;

a locking stop collar fitted over the fluid supply end adjacent the reduced diameter section, the locking collar having a front edge; and an adjustment shim located between the split threaded collar and the locking stop collar for adjusting the length to which the mandrel can be inserted into the tube.

7. A method for hydraulically expanding a tube, comprising:

a. providing an elongated cylinder made of a carbon fiber-reinforced material having a tip, a reduced diameter section and a fluid supply end;

b. providing a pair of O-rings separating the reduced diameter section from the tip and fluid supply end of the elongated cylinder;

c. inserting the elongated cylinder into a tube; and d. introducing a high pressure fluid via the fluid supply end into the reduced diameter section to hydraulically expand the tube.

* * * * *